US011725596B2

(12) United States Patent
Kikuchi

(10) Patent No.: US 11,725,596 B2
(45) Date of Patent: Aug. 15, 2023

(54) INTAKE CONTROL DEVICE

(71) Applicant: HITACHI ASTEMO, LTD., Hitachinaka (JP)

(72) Inventor: Hiroshi Kikuchi, Hitachinaka (JP)

(73) Assignee: Hitachi Astemo, Ltd., Ibaraki (JP)

( * ) Notice: Subject to any disclaimer, the term of this patent is extended or adjusted under 35 U.S.C. 154(b) by 0 days.

(21) Appl. No.: 17/766,555

(22) PCT Filed: Oct. 16, 2020

(86) PCT No.: PCT/JP2020/039073
§ 371 (c)(1),
(2) Date: Apr. 5, 2022

(87) PCT Pub. No.: WO2021/075543
PCT Pub. Date: Apr. 22, 2021

(65) Prior Publication Data

US 2023/0175445 A1 Jun. 8, 2023

(30) Foreign Application Priority Data

Oct. 18, 2019 (JP) ..... 2019-191364
Oct. 18, 2019 (JP) ..... 2019-191365
Oct. 18, 2019 (JP) ..... 2019-191366

(51) Int. Cl.
*F02D 9/14* (2006.01)
*F02M 35/10* (2006.01)

(52) U.S. Cl.
CPC ..... *F02D 9/14* (2013.01); *F02M 35/10216* (2013.01); *F02M 35/10255* (2013.01)

(58) Field of Classification Search
CPC ..... F02D 9/14; F02D 9/10; F02M 35/10216; F02M 35/10255; F02M 35/1205; F02M 35/1222
See application file for complete search history.

(56) References Cited

U.S. PATENT DOCUMENTS 5,542,385 A * 8/1996 Kim ..... F02D 9/14 123/184.52
7,249,587 B2 7/2007 Matsuda
(Continued)

FOREIGN PATENT DOCUMENTS

JP S61-084169 U 6/1986
JP H05-312045 A 11/1993
JP 2005-273527 A 10/2005
(Continued)

*Primary Examiner* — Syed O Hasan
(74) *Attorney, Agent, or Firm* — Carrier, Shende & Associates P.C; Joseph P. Carrier; Fulchand P. Shende

(57) ABSTRACT

An intake control device 1 includes: a body 3 including an intake passage 2; and a valve body 4 located in the intake passage 2. The intake passage 2 includes a direction continuation segment 13 in which a first major axis direction d1 and a second major axis direction d2 are approximately parallel to each other continuously from a downstream opening 6 of the body 3. The body 3 includes a seal plane 14 formed along a plane that intersects with part of the direction continuation segment 13. The valve body 4 includes a valve plane 15 formed by a plane that abuts the seal plane 14, and is configured to slide relative to the seal plane 14 via the valve plane 15 to adjust an opening degree of the intake passage 2.

5 Claims, 10 Drawing Sheets

(56) References Cited

U.S. PATENT DOCUMENTS

| | | | | |
|---|---|---|---|---|
| 7,730,865 | B2 * | 6/2010 | Yokoi | F02M 35/10039 123/184.55 |
| 2008/0078355 | A1 * | 4/2008 | Maehara | F02D 9/107 123/399 |

FOREIGN PATENT DOCUMENTS

| | | | |
|---|---|---|---|
| JP | 2006-112317 | A | 4/2006 |
| JP | 2006-112318 | A | 4/2006 |
| JP | 2014-098349 | A | 5/2014 |

* cited by examiner

INTAKE CONTROL DEVICE

TECHNICAL FIELD

The present invention relates to an intake control device that controls intake of an internal combustion engine.

BACKGROUND ART

A conventionally known intake control device includes: an intake passage that is part of an intake pipe connected to a combustion chamber of an internal combustion engine; and a control valve located in the intake passage to control intake (for example, see Patent Literatures 1 to 3).

An intake control device in Patent Literature 1 includes a butterfly valve as a control valve, where the outer shape of the butterfly valve and the cross-sectional shape of an intake passage are elliptical. In an engine to which this intake control device is applied, two intake valves are provided for one cylinder. In such an internal combustion engine that has two or more intake valves for one cylinder, the shape of the entrance of each intake port open to a cylinder head is often not a perfect circle.

In a control valve in an intake control device in Patent Literature 2, a quadrilateral valve body is slid so as to cross an intake passage shaped like a long hole in cross-section from one side toward the other side, to change the flow rate of intake air passing through the intake passage. A drive force transmission mechanism for sliding the valve body is located on the other side of the intake passage and downstream from a surface at which the valve body is located.

To improve the reaction speed at which the engine output changes in response to the change of the opening degree of the intake passage by the control valve, it is preferable to locate the valve body on the downstream side of the intake pipe (i.e. the intake port side) as much as possible to reduce the volume of the intake pipe downstream from the valve body.

In a control valve in an intake control device in Patent Literature 3, a valve body located in an intake passage is moved vertically from one side toward the other side of the intake passage or moved diagonally from the one side toward the other side and the upstream side, to open the intake passage and change the flow rate of intake air passing through the intake passage.

An injection port of a fuel injection valve for injecting fuel into the valve body intake passage is located on the one side or the other side and downstream from the valve body. Hence, intake air flows downstream on the one side of the valve body and is used to vaporize the fuel from the injection port of the fuel injection valve and generate an air-fuel mixture.

CITATION LIST

Patent Literatures

Patent Literature 1: Japanese Patent Application Laid-Open No. 2005-273527

Patent Literature 2: Japanese Patent Application Laid-Open No. H5-312045

Patent Literature 3: Japanese Patent Application Laid-Open No. 2006-112318

SUMMARY OF INVENTION

Technical Problem

In the case where the shape of the entrance of the intake port open to the cylinder head is not a perfect circle as in the intake control device in Patent Literature 1, to provide the butterfly valve as close to the intake port as possible, the butterfly valve needs to be located in a region of the intake passage whose cross-sectional shape is not a perfect circle. In such a case, it is very difficult in terms of manufacturing technology to ensure high accuracy for the gap between the inner wall surface of the intake passage and the outer peripheral surface of the butterfly valve, as compared with the case where the cross-sectional shape of the region is a perfect circle. This makes it difficult to accurately adjust the intake amount particularly in a region with a low opening degree.

The intake control device in Patent Literature 2 has the structure in which the drive force transmission mechanism is located downstream from the valve body. If the valve body is located more downstream, the drive force transmission mechanism interferes with the cylinder head of the engine. With such a structure, it is impossible to locate the valve body more downstream to improve the reaction speed of the engine output.

In the intake control device in Patent Literature 3, it is desirable that, in a low opening degree state in which the opening degree of the intake passage (i.e. the degree of opening of the intake passage by the valve body) is low, the flow of intake air around the injection port is improved to facilitate the vaporization of the fuel and uniformize the air-fuel mixture more reliably, from the viewpoint of driving the internal combustion engine more efficiently and stably.

In view of these problems of the conventional techniques, the present invention has an object of providing an intake control device that can accurately adjust the intake amount even in the case where a control valve is provided in a part of an intake passage whose cross-sectional shape is not a perfect circle. The present invention has another object of providing an intake control device that can locate a valve body more downstream of an intake passage without hindrance. The present invention has yet another object of providing an intake control device that can facilitate vaporization of fuel and uniformize an air-fuel mixture in a low opening degree state more reliably.

Solution to Problem

An intake control device according to the present invention is an intake control device including: a body including an intake passage that is at least part of an intake pipe leading to a combustion chamber of an internal combustion engine; and a valve body located in the intake passage, wherein the body includes an upstream opening and a downstream opening of the intake passage, the intake passage includes a direction continuation segment in which a first major axis direction and a second major axis direction are approximately parallel to each other continuously from the downstream opening, the first major axis direction being a direction orthogonal to a first parallel equal-interval dividing line group when a sum total of a product of an area of each of an unlimited number of fine openings and a shortest distance of the fine opening from a downstream center point that is an area center of the downstream opening is maximum, the unlimited number of fine openings being obtained by dividing, by the first parallel equal-interval dividing line group, a shape of the downstream opening as seen from a direction parallel to a passage center line that is a straight line connecting an upstream center point that is an area center of the upstream opening and the downstream center point, the second major axis direction being a direction orthogonal to a second parallel equal-interval dividing line group when a sum total of a product of an area of each of an unlimited number of fine passage cut shapes and a shortest distance of the fine passage cut shape from an area center of a passage cut shape that is a cross-sectional shape of the intake passage cut along any surface orthogonal to the passage center line is maximum, the unlimited number of fine passage cut shapes being obtained by dividing the passage cut shape by the second parallel equal-interval dividing line group, wherein the body includes a seal plane formed along at least part of a plane that intersects with at least part of the direction continuation segment, and wherein the valve body includes a valve plane formed by a plane that abuts the seal plane, and is configured to slide relative to the seal plane via the valve plane to adjust an opening degree of the intake passage.

According to the present invention, the valve body includes the valve plane that abuts the seal plane of the body, so that between the seal plane and the valve plane is sealed when the valve body moves in a direction intersecting with the direction continuation segment of the intake passage.

Thus, even in the case where the cross-sectional shape of the intake passage in the direction continuation segment is not circular, the opening degree of the intake passage can be set exactly depending on the position of movement of the valve body without requiring high accuracy for the gap between the intake passage and the valve body, unlike in the case where the valve body is a butterfly valve. Therefore, even in the case where the cross-sectional shape of the intake passage is complex and the opening degree of the intake passage (i.e. the degree of opening of the intake passage as a result of the movement of the valve body) is low, the intake amount can be adjusted accurately.

In the present invention, the intake control device may include: a slide block configured to be translatably guided by the body and moved along the seal plane while holding the valve body to enable the valve body to slide relative to the seal plane; and a friction reduction means provided between the body and the slide block and configured to reduce friction when the slide block is guided by the body, the slide block may include a storage hole for storing at least part of the valve body on an upstream side to allow mutual movement of the slide block and the valve body, an airtight member configured to keep the storage hole airtight may be provided between the slide block and the valve body, and the valve body may include a communicating hole through which the upstream side and a downstream side of the valve body communicate with each other and that causes inside of the storage hole to communicate with the intake passage downstream from the valve body.

With this structure, the upstream surface of the valve body stored in the storage hole is exposed to low pressure downstream from the valve body, eliminating the pressure difference between the upstream side and the downstream side for the area of the surface of the valve body stored in the storage hole. This can reduce the force exerted on the valve body from high pressure upstream from the slide block. Thus, the drive force needed to move the valve body and the slide block can be reduced, and wear of the valve body and the like caused by the movement can be reduced.

In the present invention, the valve body may be configured to slide relative to the seal plane to increase the opening degree of the intake passage in the case of moving from one side to an other side of the intake passage, and the seal plane may be inclined toward an upstream side of the intake passage with respect to the passage center line from the one side to the other side of the intake passage.

With this structure, when the opening degree of the intake passage is low, intake air is gathered on the one side of the intake passage upstream from the valve body and flows on the one side of the valve body. The intake rectifying effect can therefore be expected.

In this case, an injection port of a fuel injection valve configured to inject fuel into the intake pipe may be located on the one side of the intake passage and downstream from the valve body in the intake passage.

With this structure, when the opening degree of the intake passage is low, strong flow of intake air collides with flow of fuel discharged from the injection port of the fuel injection valve, with it being possible to facilitate vaporization of fuel and uniformize a mixture of intake air and fuel.

In this case, the valve body may include a surface lacking portion depressed and open to the one side at a valve end that is an end of the valve plane on the one side, and the surface lacking portion may be configured to be exposed into the intake passage before the valve end, during a time from when the valve body is in a fully closed state in which the opening degree of the intake passage is minimum to when the valve body is in a fully open state in which the opening degree of the intake passage is maximum.

With this structure, in a low opening degree state in which the opening degree of the intake passage is low, the surface lacking portion allows intake air to concentrate at flow of fuel from the fuel injection valve. This can further facilitate vaporization of fuel and uniformize an air-fuel mixture in a low opening degree state.

In the present invention, the valve body may be configured to slide relative to the seal plane to increase the opening degree of the intake passage in the case of moving from one side to an other side of the intake passage, the intake control device may include a first transmission mechanism configured to slide the valve body relative to the seal plane, and the first transmission mechanism may be located on the other side of the intake passage and on the upstream side of the intake passage from a first reference plane including the seal plane.

With this structure, in the case where the intake control device is placed in a downdraft manner for the cylinder head of the internal combustion engine so that intake air will flow downward, the intake control device can be located closer to the cylinder head without the first transmission mechanism interfering with the cylinder head. In this way, the volume of the intake pipe downstream from the valve body is reduced, as a result of which the response of the internal combustion engine can be improved.

An intake control device according to another aspect of the present invention is an intake control device including: a body including an intake passage that is at least part of an intake pipe leading to a combustion chamber of an internal combustion engine; and a valve body located in the intake passage, wherein the body includes a seal plane formed by a plane that extends at an angle with an extending direction of the intake passage, wherein the valve body includes a valve plane formed by a plane that abuts the seal plane, and is configured to slide relative to the seal plane via the valve plane to adjust an opening degree of the intake passage and to increase the opening degree of the intake passage in the case of moving from one side to an other side of the intake passage, wherein the seal plane is inclined toward an upstream side of the intake passage with respect to the extending direction of the intake passage from the one side to the other side of the intake passage, wherein a first transmission mechanism configured to move the valve body is located on the other side of the intake passage, and wherein the first transmission mechanism is located on the upstream side of the intake passage from a first reference plane including the seal plane.

According to the present invention, the first transmission mechanism is located on the other side of the intake passage and upstream from the first reference plane. Hence, in the case where the intake control device is placed in a downdraft manner for the cylinder head of the internal combustion engine so that intake air will flow downward, the intake control device can be located closer to the cylinder head without the first transmission mechanism interfering with the cylinder head. This allows the valve body to be located more downstream to reduce the volume of the intake pipe downstream from the valve body, as a result of which the response of the internal combustion engine can be improved.

In the present invention, the body may include an upstream opening and a downstream opening of the intake passage, the intake passage may include a direction continuation segment in which a first major axis direction and a second major axis direction are approximately parallel to each other continuously from the downstream opening, the first major axis direction being a direction orthogonal to a first parallel equal-interval dividing line group when a sum total of a product of an area of each of an unlimited number of fine openings and a shortest distance of the fine opening from a downstream center point that is an area center of the downstream opening is maximum, the unlimited number of fine openings being obtained by dividing, by the first parallel equal-interval dividing line group, a shape of the downstream opening as seen from a direction parallel to a passage center line that is a straight line connecting an upstream center point that is an area center of the upstream opening and the downstream center point, the second major axis direction being a direction orthogonal to a second parallel equal-interval dividing line group when a sum total of a product of an area of each of an unlimited number of fine passage cut shapes and a shortest distance of the fine passage cut shape from an area center of a passage cut shape that is a cross-sectional shape of the intake passage cut along any surface orthogonal to the passage center line is maximum, the unlimited number of fine passage cut shapes being obtained by dividing the passage cut shape by the second parallel equal-interval dividing line group, and the seal plane may be formed along at least part of a plane that intersects with at least part of the direction continuation segment.

With this structure, assuming that the cross-sectional area of the direction continuation segment is equal to the cross-sectional area in the case where the cross-sectional shape of the segment is a perfect circle, in the case where the valve body moves in a direction orthogonal to the first major axis direction or the second major axis direction, the stroke amount of the valve body from a fully closed position at which the opening degree of the intake passage is minimum to a fully open position at which the opening degree is maximum can be decreased as compared with the case where the cross-sectional shape of the segment is a perfect circle. Hence, the first transmission mechanism and the part storing the valve body can be reduced in size.

In the present invention, the first transmission mechanism may include a drive transmission shaft located on the other side of the intake passage and configured to rotate, the drive transmission shaft may be configured to be rotated by an electric motor that includes a drive shaft located approximately parallel to a rotation axis of the drive transmission shaft, a second transmission mechanism configured to transmit a drive force from the electric motor to the drive transmission shaft may be provided between the electric motor and the drive transmission shaft, the body may include an upstream opening and a downstream opening of the intake passage, the electric motor may be located on the one side opposite to the drive transmission shaft with the intake passage therebetween as seen from a direction orthogonal to a second reference plane that is parallel to a sliding direction of the valve body and includes a sliding center line intersecting with a passage center line and the passage center line, the passage center line being a straight line connecting an upstream center point that is an area center of the upstream opening and a downstream center point that is an area center of the downstream opening, a first reference line intersecting with the rotation axis of the drive transmission shaft and the rotation axis of the drive shaft and the first reference plane may intersect with the passage center line at respective acute corresponding angles and a corresponding angle $\beta$ of the first reference line may be greater than a corresponding angle $\alpha$ of the first reference plane as seen from a direction orthogonal to the second reference plane, and at least part of the electric motor may be located closer to the intake passage than a third reference plane is, the third reference plane being a plane parallel to the passage center line, orthogonal to the rotation axis of the drive shaft, and in contact with an edge of the intake passage on a side on which the second transmission mechanism is located.

With this structure, as a result of the corresponding angle $\beta$ of the first reference line being as close to a right angle as possible, the distance from the electric motor to the drive transmission shaft can be shortened and the second transmission mechanism can be reduced in size.

In this case, an injection port of a fuel injection valve configured to inject fuel into the intake pipe may be located on the one side of the intake passage and downstream from the valve body in the intake passage, and a main body of the fuel injection valve may be located on the one side of the intake passage and downstream from the electric motor.

With this structure, the electric motor is located on the upstream side of the intake passage due to, for example, the foregoing positional relationship between the first reference plane and the first reference line, whereas the fuel injection valve is located on the one side of the intake passage and downstream from the electric motor. Thus, the injection port of the fuel injection valve can be provided at such a position that is advantageous in vaporizing fuel and uniformizing an air-fuel mixture when the intake passage is in a low opening degree state.

In this case, the intake control device may include a first coupler to which a first power supply terminal configured to supply power to the fuel injection valve is connected and a second coupler to which a second power supply terminal configured to supply power to the electric motor is connected, on the one side of the intake passage, and a first opening of the first coupler for receiving the first power supply terminal and a second opening of the second coupler for receiving the second power supply terminal may be both open to the one side.

With this structure, as a result of the first opening of the first coupler and the second opening of the second coupler being both open to the one side, power supply wiring to the fuel injection valve and the electric motor can be advantageously routed.

In the present invention, the intake control device may include an opening degree sensor configured to detect a rotation angle of the drive transmission shaft, and the opening degree sensor may be located at an end of the drive transmission shaft on a side on which the second transmission mechanism is located as seen from a direction parallel to the passage center line.

With this structure, in the case where the intake control device is mounted in an engine of a motorcycle in a downdraft manner, the opening degree sensor and the second transmission mechanism can be arranged along a frame of the motorcycle, so that the intake control device can be prevented from interfering with the frame of the motorcycle.

An intake control device according to yet another aspect of the present invention is an intake control device including: a body including an intake passage that is at least part of an intake pipe leading to a combustion chamber of an internal combustion engine; and a valve body located in the intake passage, wherein the body includes a seal plane formed by a plane that extends at an angle with an extending direction of the intake passage, wherein the valve body includes a valve plane formed by a plane that abuts the seal plane, and is configured to slide relative to the seal plane via the valve plane to adjust an opening degree of the intake passage and to increase the opening degree of the intake passage in the case of moving from one side to an other side of the intake passage, wherein an injection port of a fuel injection valve configured to inject fuel into the intake pipe is located downstream from the valve body in the intake passage, wherein the injection port is located on the one side of the intake passage, wherein the valve body includes a surface lacking portion depressed and open to the one side at a valve end that is an end of the valve plane on the one side, and wherein the surface lacking portion is configured to be exposed into the intake passage before the valve end, during a time from when the valve body is in a fully closed state in which the opening degree of the intake passage is minimum to when the valve body is in a fully open state in which the opening degree is maximum.

According to the present invention, intake air flows downstream on the one side of the valve body. In a low opening degree state in which the opening degree of the intake passage (i.e. the degree of opening of the intake passage as a result of the movement of the valve body) is low, this flow mostly passes through the surface lacking portion of the valve body and concentrates at flow of fuel from the fuel injection valve. This can facilitate vaporization of fuel and uniformization of an air-fuel mixture in a low opening degree state.

In the present invention, the body may include an upstream opening and a downstream opening of the intake passage, the intake passage may include a direction continuation segment in which a first major axis direction and a second major axis direction are approximately parallel to each other continuously from the downstream opening, the first major axis direction being a direction orthogonal to a first parallel equal-interval dividing line group when a sum total of a product of an area of each of an unlimited number of fine openings and a shortest distance of the fine opening from a downstream center point that is an area center of the downstream opening is maximum, the unlimited number of fine openings being obtained by dividing, by the first parallel equal-interval dividing line group, a shape of the downstream opening as seen from a direction parallel to a passage center line that is a straight line connecting an upstream center point that is an area center of the upstream opening and the downstream center point, the second major axis direction being a direction orthogonal to a second parallel equal-interval dividing line group when a sum total of a product of an area of each of an unlimited number of fine passage cut shapes and a shortest distance of the fine passage cut shape from an area center of a passage cut shape that is a cross-sectional shape of the intake passage cut along any surface orthogonal to the passage center line is maximum, the unlimited number of fine passage cut shapes being obtained by dividing the passage cut shape by the second parallel equal-interval dividing line group, the seal plane may form at least part of a plane that intersects with at least part of the direction continuation segment, and a direction in which the valve body slides along the seal plane may be a direction perpendicular to the first major axis direction or the second major axis direction.

When moving the valve body in a direction perpendicular to the first major axis direction or the second major axis direction to increase the opening degree of the intake passage as seen from a direction parallel to the passage center line, the open part of the intake passage resulting from the movement of the valve body is distributed long in the horizontal direction and the flow of intake air disperses in a low opening degree region in which the opening degree is low, unless some kind of measure is taken. According to the structure described above, however, the valve body has the surface lacking portion, so that the air flow can be concentrated at a desired position by the surface lacking portion.

Hence, even in the case where the seal plane is provided in the direction continuation segment in which the first major axis direction and the second major axis direction are approximately parallel to each other continuously from the downstream opening, it is possible to facilitate vaporization of fuel and uniformize an air-fuel mixture in a low opening degree region more reliably.

In the present invention, the seal plane may be inclined toward an upstream side with respect to the extending direction of the intake passage from the one side to the other side.

With this structure, when the opening degree of the intake passage is low, intake air is gathered on the one side of the intake passage upstream from the valve body and flows on the one side of the valve body. The intake rectifying effect can therefore be expected.

In this case, the intake control device may include a first transmission mechanism located on the other side of the intake passage and upstream from a first reference plane including the seal plane and configured to drive the valve body.

With this structure, in the case where the intake control device is placed in a downdraft manner for the cylinder head of the internal combustion engine, the intake control device can be located closer to the cylinder head without the first transmission mechanism interfering with the cylinder head. In this way, the volume of the intake pipe downstream from the valve body is reduced, as a result of which the response of the internal combustion engine to the change of the opening degree of the intake passage can be improved.

DESCRIPTION OF EMBODIMENTS

Figure 1:
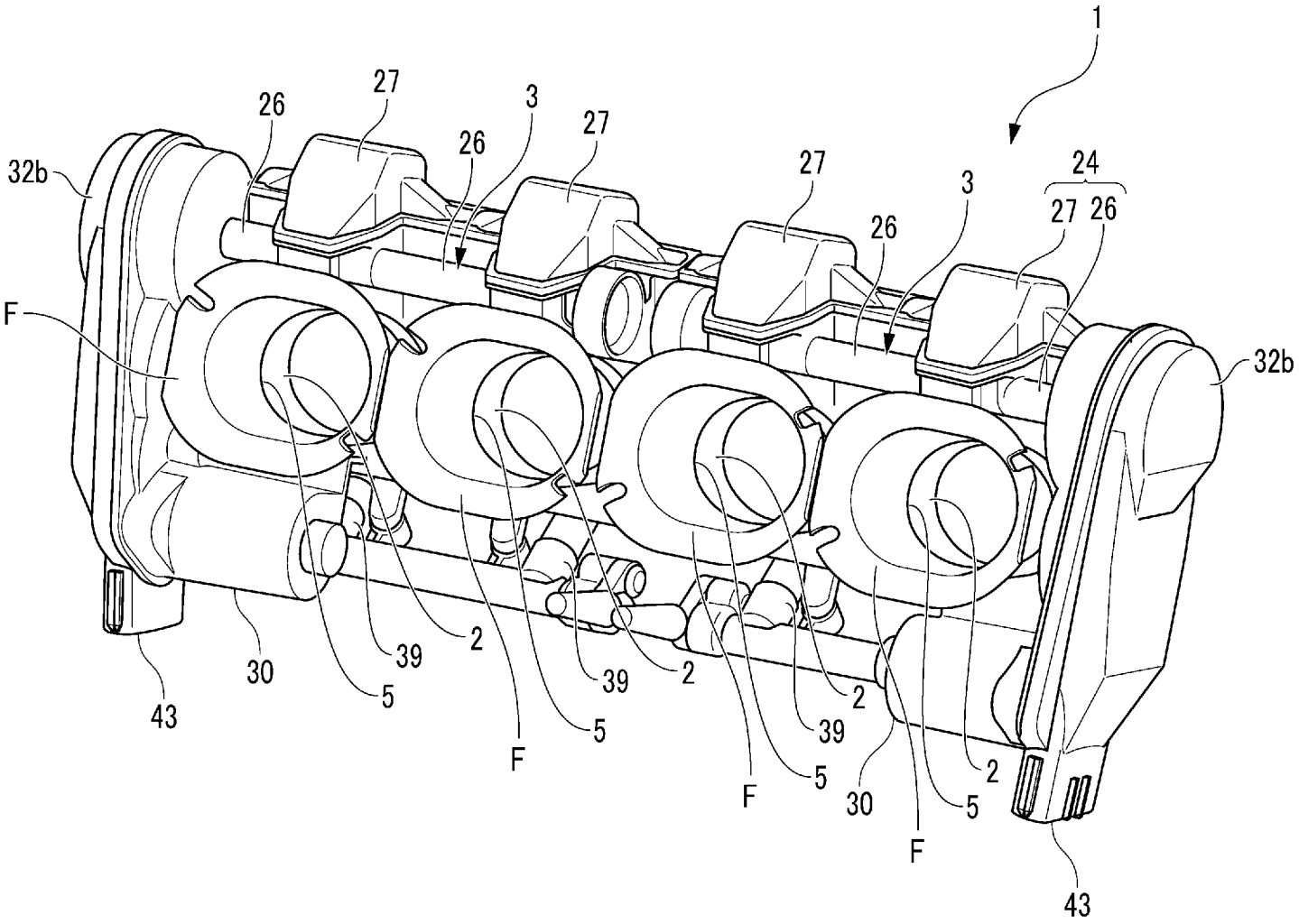
FIG. 1 is a perspective diagram illustrating an intake control device according to an embodiment of the present invention.
Figure 2:
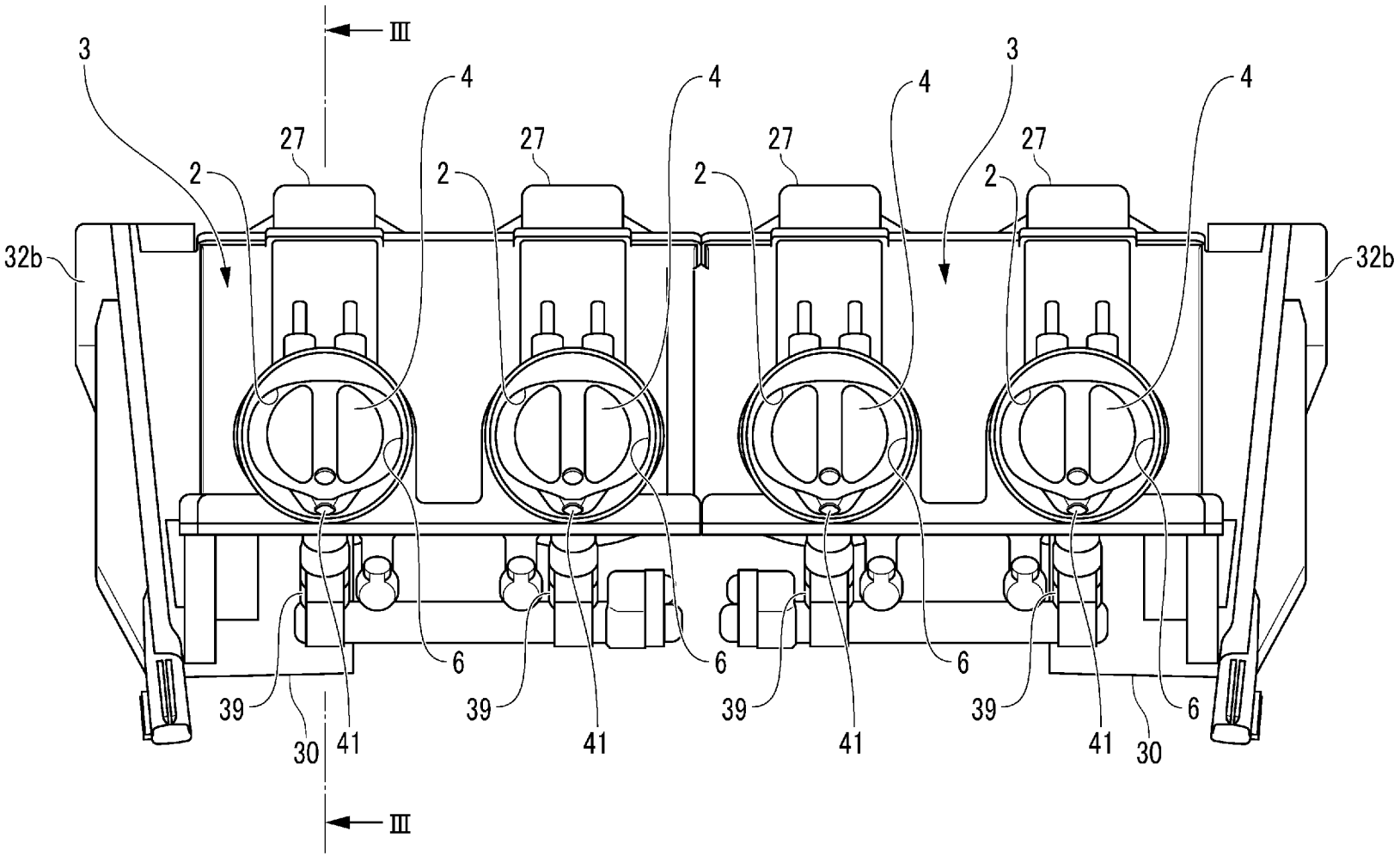
FIG. 2 is a front diagram of the intake control device in FIG. 1 as seen from the downstream side.

An embodiment of the present invention will be described below, with reference to the drawings. As illustrated in FIG. 1 and FIG. 2, an intake control device 1 according to an embodiment of the present invention includes two bodies 3 each of which includes two intake passages 2 that are each at least part of an intake pipe leading to a combustion chamber of an internal combustion engine, and a valve body 4 located in each intake passage 2.

Thus, the intake control device 1 is suitable for being mounted in a straight-four engine as an internal combustion engine. Each body 3 includes an upstream opening 5 and a downstream opening 6 of each intake passage 2. A funnel F is provided on the upstream side of the intake passage 2.

Figure 3:
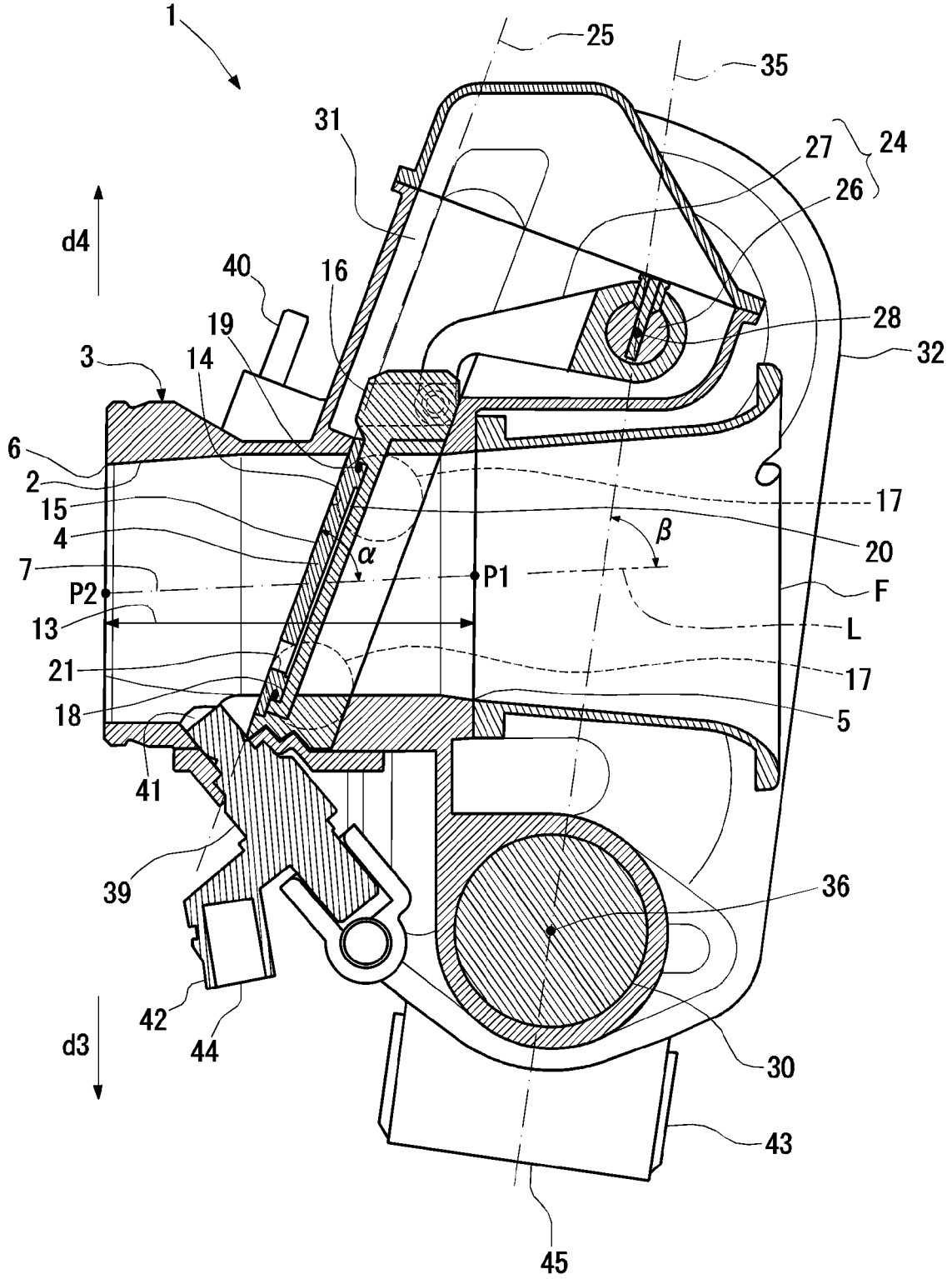
FIG. 3 is a cross-sectional diagram taken along line in FIG. 2.
Figure 4:
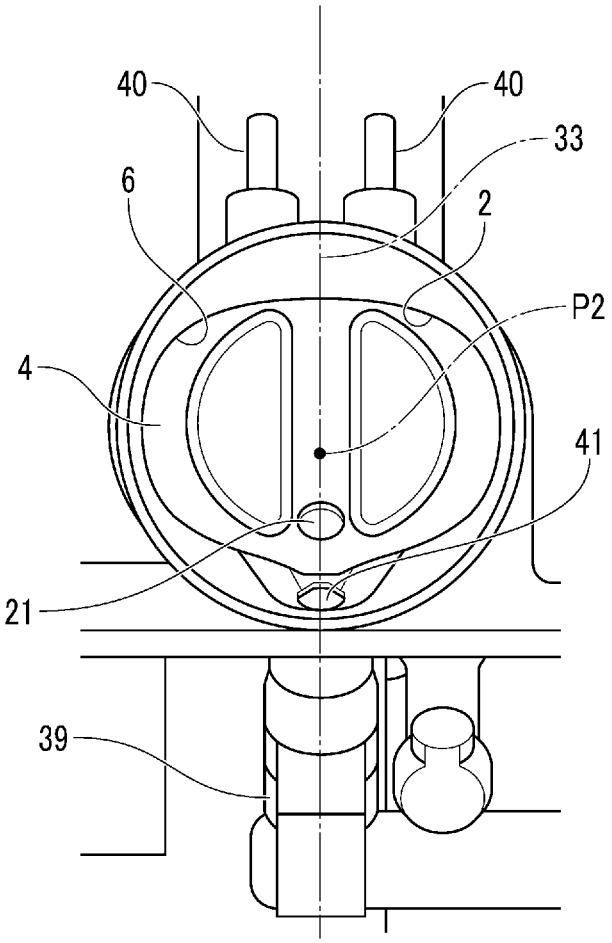
FIG. 4 is an enlarged diagram illustrating a part in FIG. 2.

Herein, as illustrated in FIG. 3 and FIG. 4, a passage center line 7 is a straight line connecting an upstream center point P1 which is an area center of the upstream opening 5 and a downstream center point P2 which is an area center of the downstream opening 6.

Figure 5A:
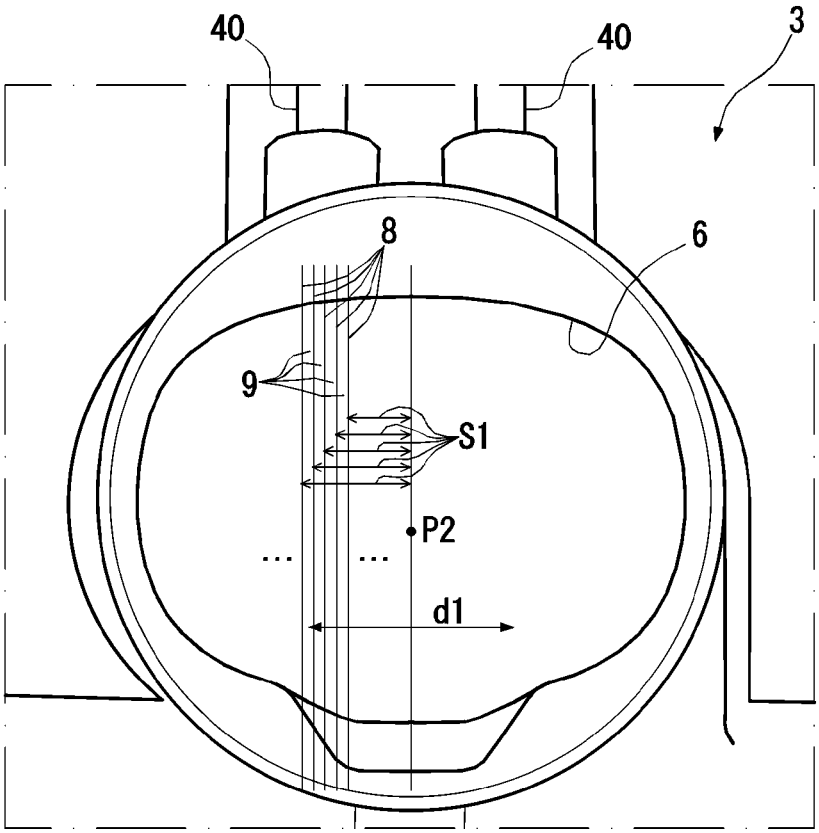
FIG. 5A is a diagram illustrating a first major axis direction in a shape of a downstream opening in the intake control device in FIG. 1.

As illustrated in FIG. 5A, a first major axis direction d1 is a direction orthogonal to a first parallel equal-interval dividing line group 8 when the sum total of the product of the area of each of an unlimited number of fine openings 9 obtained by dividing, by the first parallel equal-interval dividing line group 8, the shape of the downstream opening 6 as seen from a direction parallel to the passage center line 7 and the shortest distance S1 of the fine opening 9 from the downstream center point P2 is maximum.

Figure 5B:
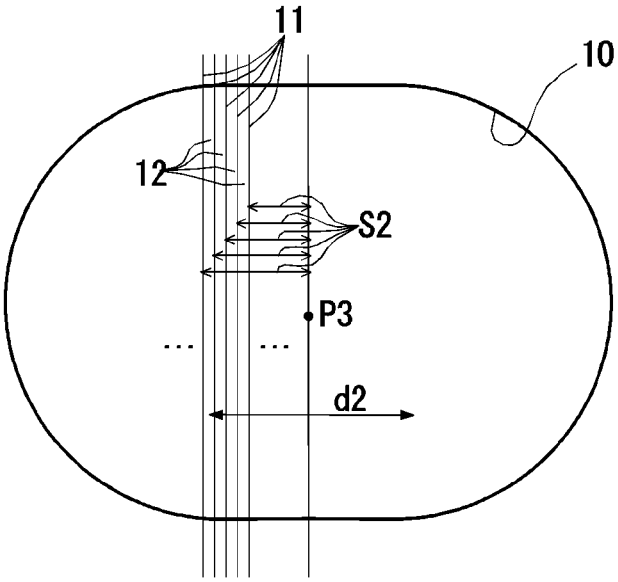
FIG. 5B is a diagram illustrating a second major axis direction in a passage cut shape in the intake control device in FIG. 1.

As illustrated in FIG. 5B, a second major axis direction d2 is a direction orthogonal to a second parallel equal-interval dividing line group 11 when the sum total of the product of the area of each of an unlimited number of fine passage cut shapes 12 obtained by dividing, by the second parallel equal-interval dividing line group 11, a passage cut shape 10 which is the cross-sectional shape of the intake passage 2 cut along any surface orthogonal to the passage center line 7 and the shortest distance S2 of the fine passage cut shape 12 from the area center P3 of the passage cut shape 10 is maximum.

The intake passage 2 includes a direction continuation segment 13 (see FIG. 3) in which the first major axis direction d1 and the second major axis direction d2 are approximately parallel to each other continuously from the downstream opening 6. In this embodiment, the entire intake passage 2 is the direction continuation segment 13.

As illustrated in FIG. 3, the body 3 includes a seal plane 14 formed along at least part of a plane that intersects with at least part of the direction continuation segment 13. The seal plane 14 is formed at a wall portion of the intake passage 2 by a plane extending at an angle with the extending direction of the intake passage 2, and is inclined toward the upstream side of the intake passage 2 with respect to the passage center line 7 from one side d3 to the other side d4 of the intake passage 2.

The valve body 4 includes a valve plane 15 formed by a plane that abuts the seal plane 14, and slides relative to the seal plane 14 via the valve plane 15 to adjust the opening degree of the intake passage 2 (i.e. the degree of opening of the intake passage 2 as a result of the movement of the valve body 4).

In detail, the opening degree of the intake passage 2 is adjusted by the valve plane 15 blocking, by an area corresponding to each position of the valve body 4, a cross-section of the intake passage 2 cut along a surface including the seal plane 14. The direction in which the valve body 4 slides along the seal plane 14 is a direction (minor axis direction) perpendicular to the first major axis direction d1 or the second major axis direction d2.

The body 3 is provided with a slide block 16 that is translatably guided by the body 3 and is moved along the seal plane 14 while holding the valve body 4 to enable the valve body 4 to slide relative to the seal plane 14. A friction reduction means that reduces friction when the slide block 16 is guided by the body 3 is provided between the body 3 and the slide block 16.

Figure 6:
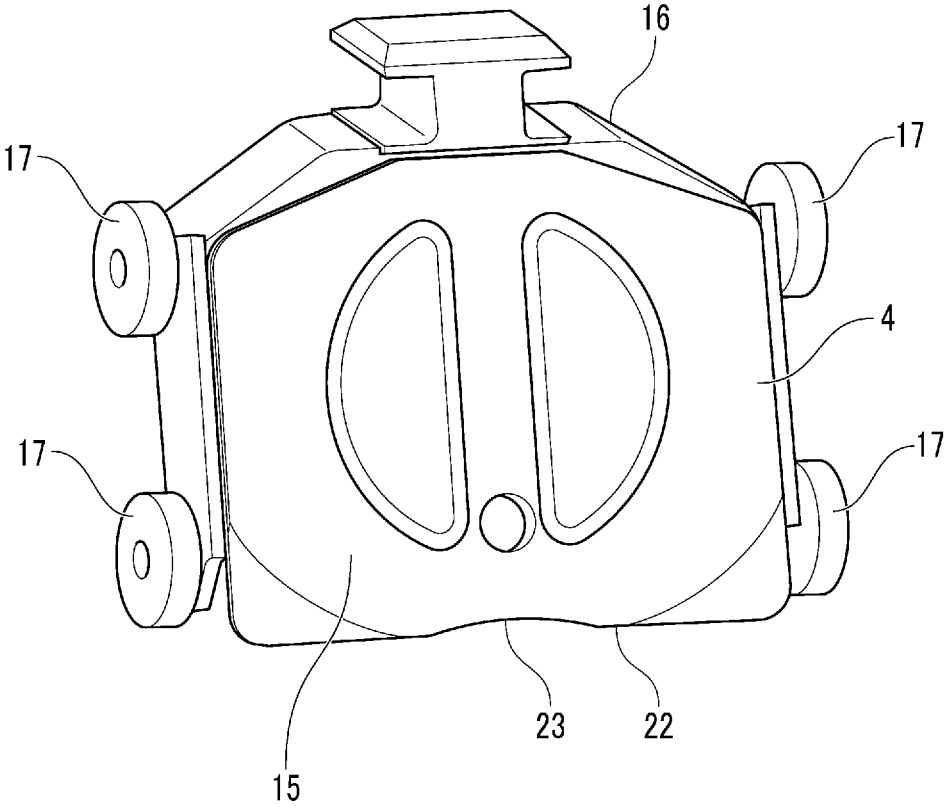
FIG. 6 is a perspective diagram illustrating a valve body held by a slide block in the intake control device in FIG. 1.

As illustrated in FIG. 6, rollers 17 that are rotatably supported by the slide block 16 and roll on a guide plane provided in the body 3 are used as the friction reduction means in this embodiment.

As illustrated in FIG. 3, the slide block 16 includes a storage hole 18 for storing at least part of the valve body 4 on the upstream side to allow mutual movement of the slide block 16 and the valve body 4. An airtight member 19 that keeps the storage hole 18 airtight is provided between the slide block 16 and the valve body 4. For example, a lip seal may be used as the airtight member 19.

The slide block 16 and the valve body 4 are fitted together so as to be mutually movable in the depth direction of the storage hole 18. The valve body 4 includes a communicating hole 21 through which the upstream side and the downstream side of the valve body 4 communicate with each other and that causes a received pressure reduction space 20 inside the storage hole 18 to communicate with the intake passage 2 downstream from the valve body 4. The communicating hole 21 maintains the pressure inside the received pressure reduction space 20 to be equal to low pressure on the downstream side of the valve body 4 in the intake passage 2. Thus, the received pressure reduction space 20 for reducing the force of biasing the valve body 4 toward the seal plane 14 is formed between the slide block 16 and the valve body 4.

As illustrated in FIG. 6, the valve body 4 includes, at a valve end 22 on the one side d3 (see FIG. 3) of the valve plane 15, a surface lacking portion 23 depressed and open to the one side d3 along the valve plane 15. In detail, the surface lacking portion 23 extends from the tip of the valve end 22 toward the other side d4 (see FIG. 3) along the valve plane 15, and has a curvature greater than the curvature of the inner surface of the intake passage 2 on the other side d4.

The surface lacking portion 23 is configured to be exposed into the intake passage before the valve end 22, during the time from when the valve body 4 is in a fully closed state in which the opening degree of the intake passage 2 is minimum to when the valve body 4 is in a fully open state in which the opening degree is maximum.

In the intake control device 1 having these components, the valve body 4 is configured to increase the opening degree of the intake passage 2 in the case of sliding relative to the seal plane 14 to move from the one side d3 toward the other side d4 of the intake passage 2.

As illustrated in FIG. 3, the drive force for sliding the valve body 4 relative to the seal plane 14 is transmitted from a first transmission mechanism 24. The first transmission mechanism 24 is located on the other side d4 of the intake passage 2 and on the upstream side of the intake passage 2 from a first reference plane 25 including the seal plane 14.

The first transmission mechanism 24 includes a drive transmission shaft 26 that is located on the other side d4 of the intake passage 2 and rotates, and an arm-shaped valve body drive portion 27 whose base end is fixed to the drive transmission shaft 26 and whose tip end is linked to the slide block 16 rotatably and translatably.

The drive transmission shaft 26 is rotated by an electric motor 30 including a drive shaft 29 (see FIG. 7) approximately parallel to the rotation axis 28 of the drive transmission shaft 26. A valve body storage portion 31 for storing the valve body 4 and the like that slide to an open position is provided in the space in which the first transmission mechanism 24 is stored.

Thus, the valve body storage portion 31 functions as a space for allowing, when the valve body 4 opens, the tip end of the valve body drive portion 27 that swings as a result of the rotation of the drive transmission shaft 26, the slide block 16 linked to the tip end of the valve body drive portion 27, and the valve body 4 held by the slide block 16 to move in the sliding direction of the valve body 4 without hindrance.

Figure 7:
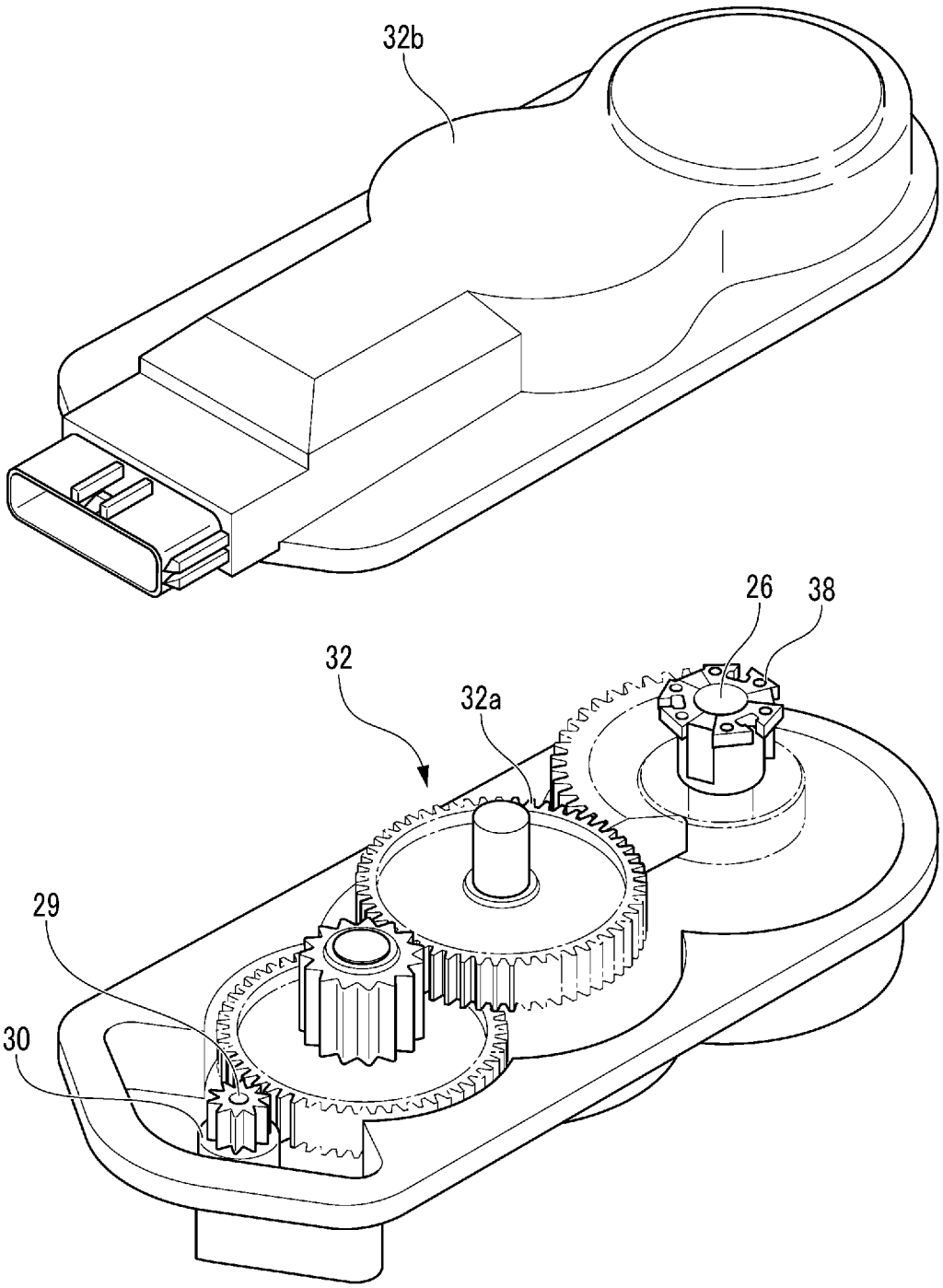
FIG. 7 is a perspective diagram illustrating a second transmission mechanism in the intake control device in FIG. 1.

As illustrated in FIG. 7, a second transmission mechanism 32 that includes a distance gear 32*a* and the like and transmits a drive force from the electric motor 30 to the drive transmission shaft 26 is provided between the electric motor 30 and the drive transmission shaft 26. The second transmission mechanism 32 is covered with a sensor cover 32*b*.

As illustrated in FIG. 3 and FIG. 4, the electric motor 30 is located on the one side d3 opposite to the drive transmission shaft 26 with the intake passage 2 therebetween as seen from a direction orthogonal to a second reference plane 33 that is parallel to the sliding direction of the valve body 4 and includes a sliding center line intersecting with the passage center line 7 and the passage center line 7.

A first reference line 35 that intersects with the rotation axis 28 of the drive transmission shaft 26 and the rotation axis 36 of the drive shaft 29 and the first reference plane 25 intersect with a line L including the passage center line 7 at respective acute corresponding angles and the corresponding angle β of the first reference line 35 is greater than the corresponding angle α of the first reference plane 25 as seen from a direction orthogonal to the second reference plane 33.

Figure 8:
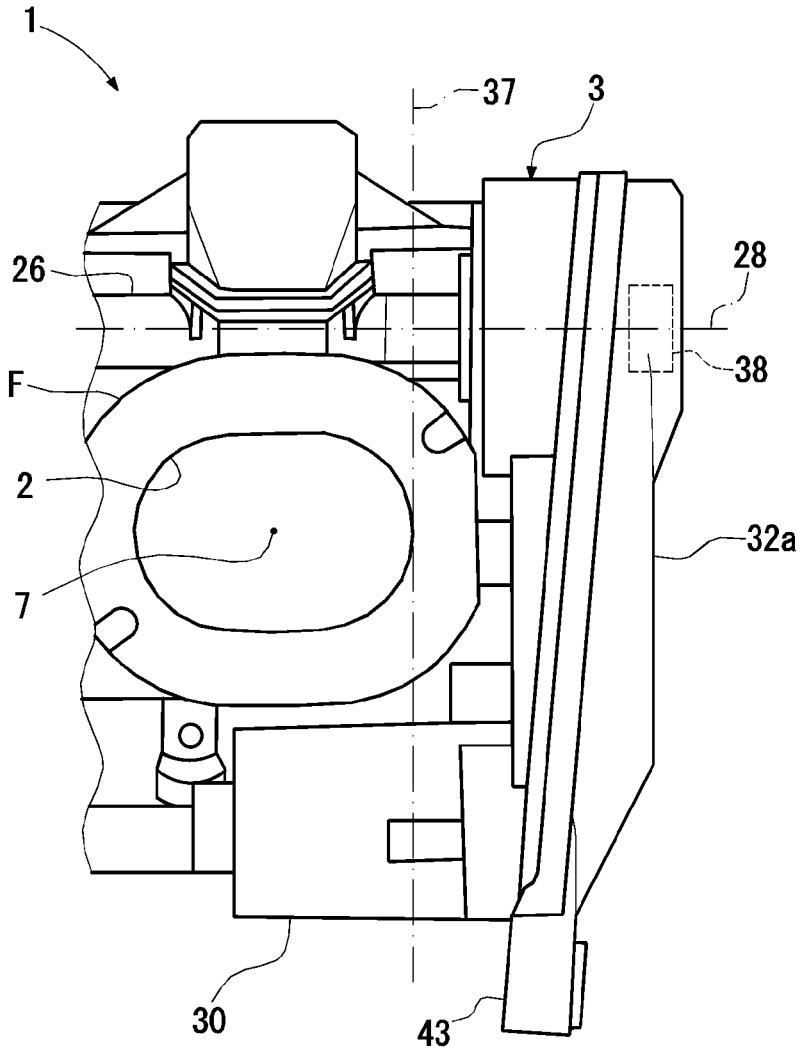
FIG. 8 is an enlarged diagram illustrating a part of the intake control device in FIG. 1 as seen from the upstream side.

As illustrated in FIG. 8, at least part of the electric motor 30 is closer to the intake passage 2 than a third reference plane 37 is. The third reference plane 37 is a plane parallel to the passage center line 7, orthogonal to the rotation axis 28 of the drive transmission shaft 26, and in contact with the edge of the intake passage 2 on the side on which the second transmission mechanism 32 is located.

An opening degree sensor 38 that detects the rotation angle of the drive transmission shaft 26 is located at the end of the drive transmission shaft 26 on the side on which the second transmission mechanism 32 is located as seen from a direction parallel to the passage center line 7. A detection portion of the opening degree sensor 38 is provided on the back of the sensor cover 32*b*. In FIG. 7, the portion detected by the opening degree sensor 38 is fixed to the drive transmission shaft 26.

As illustrated in FIG. 3, an injection port 41 of a fuel injection valve 39 that injects fuel into the intake passage 2 is located on the one side d3 of the intake passage 2 and downstream from the valve body 4 in the intake passage 2. A main body of the fuel injection valve 39 is located on the one side d3 of the intake passage 2 and downstream from the electric motor 30. A first coupler 42 to which a first power supply terminal for supplying power to the fuel injection valve 39 is connected and a second coupler 43 to which a second power supply terminal for supplying power to the electric motor 30 is connected are provided on the one side d3 of the intake passage 2. A first opening 44 of the first coupler 42 for receiving the first power supply terminal and a second opening 45 of the second coupler 43 for receiving the second power supply terminal are both open to the one side d3.

As illustrated in FIG. 3 and FIG. 4, two joints 40 are provided on the other side d4 and on the downstream side of the intake passage 2 from the valve body 4. Each joint 40 is connected to a passage that is open to the inner wall of the intake passage 2 on the other side d4 and the downstream side. A conduit for introducing purged fuel from a canister into the intake passage 2 is connected to one joint 40. A conduit to a sensor for measuring the pressure in the intake pipe downstream from the valve body 4 is connected to the other joint 40.

When the intake control device 1 having this structure controls intake air, the electric motor 30 is driven and the position of the valve body 4 is adjusted to achieve the target opening degree of the intake passage 2.

Here, the drive force of the electric motor 30 is transmitted to the drive transmission shaft 26 of the first transmission mechanism 24 via the second transmission mechanism 32, and the valve body drive portion 27 swings with the rotation of the drive transmission shaft 26. The slide block 16 is thus moved along the first reference plane 25 from the one side d3 to the other side d4 of the intake passage 2 or from the other side d4 to the one side d3 of the intake passage 2.

During this, the rotation angle of the drive transmission shaft 26 is monitored by the opening degree sensor 38. The monitoring result is fed back to the drive amount of the electric motor 30, with reference to the target opening degree. The valve body 4 is thus positioned at the target opening degree.

During the movement of the valve body 4, between the seal plane 14 and the valve plane 15 is sealed. The load placed between the seal plane 14 and the valve plane 15 is reduced as a result of the communicating hole 21 maintaining the pressure inside the received pressure reduction space 20 to be equal to low pressure on the downstream side of the valve body 4 in the intake passage 2.

Due to the difference between the pressure inside the received pressure reduction space 20 and the high pressure upstream from the slide block 16, a force of biasing to the downstream side of the intake passage 2 is exerted on the slide block 16. Here, since the rollers 17 are provided between the body 3 and the slide block 16, the valve body 4 can be slid relative to the seal plane 14 very smoothly.

In the case where the intake passage 2 opens from the fully closed state with the movement of the valve body 4, the surface lacking portion 23 is exposed into the intake passage 2 before the valve end 22. Meanwhile, the seal plane 14 is inclined toward the upstream side of the intake passage 2. Therefore, in a low opening degree state in which the opening degree is low, intake air is rectified and concentrated at flow of fuel from the fuel injection valve 39, thus facilitating vaporization of fuel and uniformization of an air-fuel mixture.

The valve body 4 moves in a direction (minor axis direction) perpendicular to the first major axis direction d1 or the second major axis direction d2 which is the major axis direction of the elliptical cross-section of the intake passage 2, until the fully open state is reached. Hence, the valve body 4 can reach the fully open state with a relatively small amount of movement for the cross-sectional area of the intake passage 2. Likewise, the valve body 4 can return from the fully open state to the fully closed state with a relatively small amount of movement.

As described above, according to this embodiment, between the seal plane 14 and the valve plane 15 is sealed when the valve body 4 moves. Thus, even in the case where the cross-sectional shape of the intake passage 2 is a complex shape that is not circular, the opening degree of the intake passage 2 can be set exactly depending on the position of movement of the valve body 4 without requiring high accuracy for the gap between the intake passage 2 and the valve body 4. Therefore, even in the case where the cross-sectional shape of the intake passage 2 is complex and the opening degree of the intake passage 2 is low, the intake amount can be adjusted accurately.

Moreover, part of the valve body 4 is held in the storage hole 18 of the slide block 16, and the inside of the storage hole 18 is made equal to the pressure downstream from the valve body 4 to thus form the received pressure reduction space 20. This can reduce the load exerted between part of the valve plane 15 and the seal plane 14. Further, since the rollers 17 are provided between the body 3 and the slide block 16, the drive force needed to move the valve body 4 and the slide block 16 can be reduced, and wear of the valve body 4 and the like during the movement can be reduced.

Moreover, since the seal plane 14 is inclined with respect to the intake passage 2 as mentioned above, when the opening degree of the intake passage 2 is low, intake air gathers on the one side d3 of the intake passage 2 upstream from the valve body 4 and flows on the one side d3 of the valve body 4. The intake air can thus be rectified.

Moreover, the injection port 41 of the fuel injection valve 39 for injecting fuel into the intake pipe is located on the one side d3 of the intake passage 2 and downstream from the valve body 4 in the intake passage 2. Hence, when the opening degree of the intake passage 2 is low, strong flow of intake air collides with flow of fuel discharged from the injection port 41, with it being possible to vaporize fuel and uniformize an air-fuel mixture.

Figure 9:
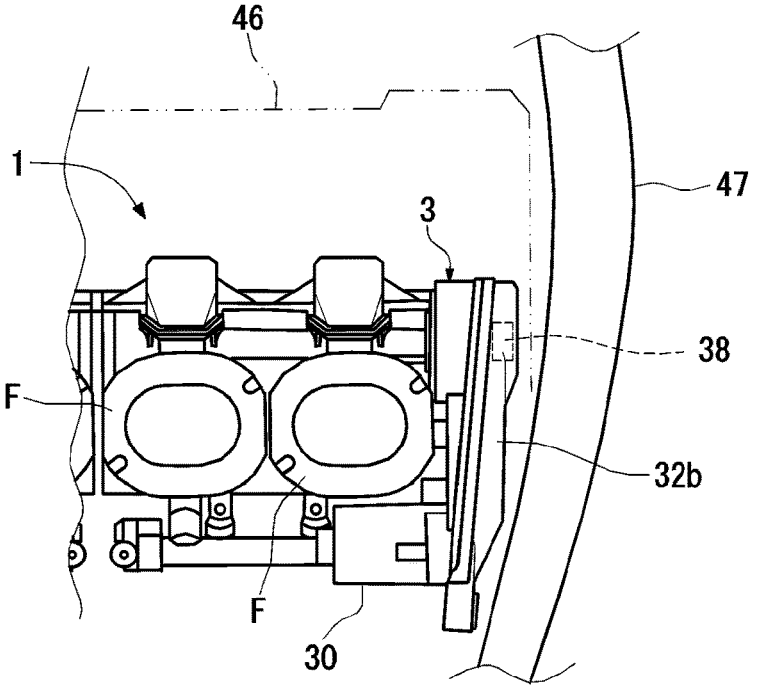
FIG. 9 is a diagram illustrating the positional relationship between a frame of a motorcycle and the intake control device in FIG. 1 in the case where the intake control device is mounted in the motorcycle.

Moreover, in the case where the intake control device 1 is mounted in the engine 46 of a motorcycle in a downdraft manner, the foregoing arrangement of the opening degree sensor 38, the second transmission mechanism 32, and the like and the shape of the sensor cover 32*b* along these components can prevent the intake control device 1 from interfering with a frame 47 of the motorcycle, as illustrated in FIG. 9.

Figure 10:
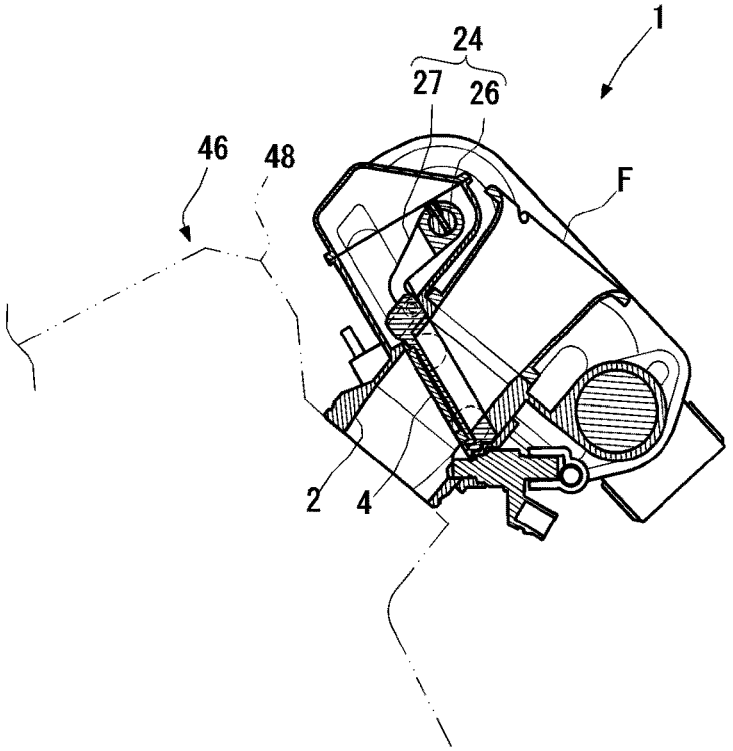
FIG. 10 is a diagram illustrating the positional relationship between an engine of a motorcycle and the intake control device in FIG. 1 in the case where the intake control device is mounted in the motorcycle.

Moreover, the first transmission mechanism 24 is located on the other side d4 of the intake passage 2 and on the upstream side of the intake passage 2 from the first reference plane 25 including the seal plane 14, as illustrated in FIG. 3. Accordingly, in the case where the intake control device 1 is placed in a downdraft manner for the cylinder head 48 of the engine 46, the intake control device 1 can be located closer to the cylinder head 48 without the first transmission mechanism 24 interfering with the cylinder head 48, as illustrated in FIG. 10. In this way, the volume of the intake pipe downstream from the valve body 4 is reduced, as a result of which the response of the engine 46 can be enhanced.

Moreover, since the seal plane 14 is a plane that intersects with the direction continuation segment 13, the stroke amount of the valve body 4 from the fully closed state in which the opening degree of the intake passage 2 is minimum to the fully open state in which the opening degree is maximum can be decreased. Hence, the first transmission mechanism 24 and the valve body storage portion 31 can be reduced in size.

Moreover, as a result of the angle β of the first reference line 35 with the extending direction of the intake passage 2 (the direction of the passage center line 7) being as close to a right angle as possible, the distance from the electric motor 30 to the drive transmission shaft 26 can be shortened and the second transmission mechanism 32 can be reduced in size.

Moreover, the electric motor 30 is located on the upstream side of the intake passage 2 due to, for example, the foregoing positional relationship between the first reference plane 25 and the first reference line 35. Thus, the injection port 41 of the fuel injection valve 39 can be provided at such a position that is advantageous in vaporizing fuel and uniformizing an air-fuel mixture in a low opening degree state in which the opening degree of the intake passage 2 is low.

Moreover, as a result of the first opening 44 of the first coupler 42 and the second opening 45 of the second coupler 43 being both open to the one side d3, wiring to these parts can be advantageously routed.

Moreover, in the case where the intake passage 2 opens from the fully closed state, the surface lacking portion 23 is exposed into the intake passage 2 before the valve end 22. Therefore, intake air is concentrated at flow of fuel from the fuel injection valve 39, thus further facilitating vaporization of fuel and uniformization of an air-fuel mixture in a low opening degree state.

Figure 11A:
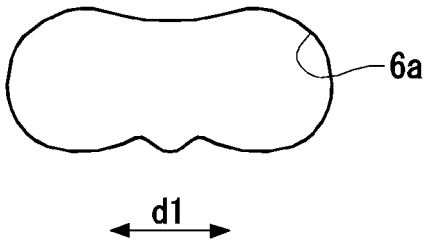
FIG. 11A is a diagram illustrating another example of the shape of the downstream opening in the intake control device in FIG. 1.
Figure 11B:
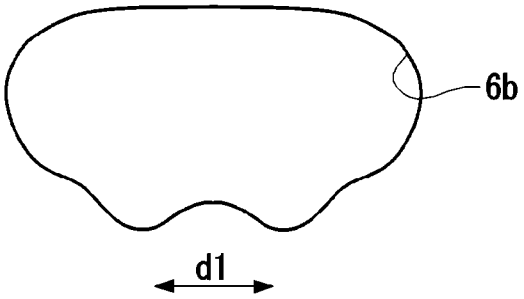
FIG. 11B is a diagram illustrating yet another example of the shape of the downstream opening in the intake control device in FIG. 1.
Figure 11C:
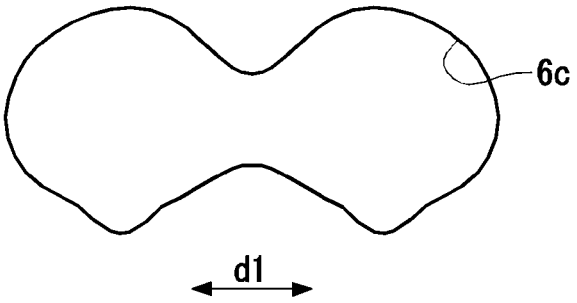
FIG. 11C is a diagram illustrating yet another example of the shape of the downstream opening in the intake control device in FIG. 1.

While the embodiment of the present invention has been described above, the present invention is not limited to such. For example, the shape of the downstream opening of the intake passage 2 may be the shape of any of downstream openings 6*a* to 6*c* illustrated in FIG. 11A to FIG. 11C respectively. In each example, the first major axis direction d1 is defined in the same way as in FIG. 5A. The internal combustion engine to which the present invention is applied is not limited to a straight-four engine, and may be an engine of any other form and any other number of cylinders.

DESCRIPTION OF REFERENCE NUMERALS

1 intake control device
2 intake passage
3 body
4 valve body

5 upstream opening
6, 6*a* to 6*c* downstream opening
7 passage center line
8 first parallel equal-interval dividing line group
9 fine opening
10 passage cut shape
11 second parallel equal-interval dividing line group
12 fine passage cut shape
13 direction continuation segment
14 seal plane
15 valve plane
16 slide block
17 roller
18 storage hole
19 airtight member
20 received pressure reduction space
21 communicating hole
22 valve end
23 surface lacking portion
24 first transmission mechanism
25 first reference plane
26 drive transmission shaft
27 valve body drive portion
28 rotation axis
29 drive shaft
30 electric motor
31 valve body storage portion
32 second transmission mechanism
32*a* distance gear
32*b* sensor cover
33 second reference plane
35 first reference line
36 rotation axis
37 third reference plane
38 opening degree sensor
39 fuel injection valve
40 joint
41 injection port
42 first coupler
43 second coupler
44 first opening
45 second opening
46 engine
47 frame
48 cylinder head
d1 first major axis direction
d2 second major axis direction
d3 one side
d4 other side
F funnel
P1 upstream center point
P2 downstream center point
S1, S2 shortest distance
P3 area center

The invention claimed is:

1. An intake control device comprising:

a body including an intake passage that is at least part of an intake pipe leading to a combustion chamber of an internal combustion engine; and a valve body located in the intake passage, wherein the body includes a seal plane formed by a plane that extends at an angle with an extending direction of the intake passage, wherein the valve body includes a valve plane formed by a plane that abuts the seal plane, and is configured to slide relative to the seal plane via the valve plane to adjust an opening degree of the intake passage and to increase the opening degree of the intake passage in a case of moving from one side to an other side of the intake passage, wherein a first transmission mechanism configured to drive the valve body is located on the other side of the intake passage, wherein the first transmission mechanism is located on an upstream side of the intake passage from a first reference plane including the seal plane, and includes a drive transmission shaft located on the other side of the intake passage and configured to rotate, wherein the drive transmission shaft is configured to be rotated by an electric motor that includes a drive shall located approximately parallel to a rotation axis of the drive transmission shaft, wherein a second transmission mechanism configured to transmit a drive force from the electric motor to the drive transmission shaft is provided between the electric motor and the drive transmission shaft, wherein the body includes an upstream opening and a downstream opening of the intake passage, wherein the electric motor is located on the one side opposite to the drive transmission shaft with the intake passage therebetween as seen from a direction orthogonal to a second reference plane that is parallel to a sliding direction of the valve body and includes a sliding center line intersecting with a passage center line and the passage center line, the passage center line being a straight line connecting an upstream center point that is an area center of the upstream opening and a downstream center point that is an area center of the downstream opening, wherein a first reference line intersecting with the rotation axis of the drive transmission shaft and the rotation axis of the drive shaft, and the first reference plane intersect with the passage center line at respective acute corresponding angles and a corresponding angle of the first reference line is greater than a corresponding angle of the first reference plane as seen from a direction orthogonal to the second reference plane, and wherein at least part of the electric motor is located closer to the intake passage than a third reference plane, the third reference plane being a plane parallel to the passage center line, orthogonal to the rotation axis of the drive shaft, and in contact with an edge of the intake passage on a side on which the second transmission mechanism is located.

2. The intake control device according to claim 1, wherein an injection port of a fuel injection valve configured to inject fuel into the intake pipe is located on the one side of the intake passage and downstream from the valve body in the intake passage, and wherein a main body of the fuel injection valve is located on the one side of the intake passage and downstream from the electric motor.

3. The intake control device according to claim 2, comprising a first coupler to which a first power supply terminal configured to supply power to the fuel injection valve is connected and a second couplet to which a second power supply terminal configured to supply power to the electric motor is connected, on the one side of the intake passage, wherein a first opening of the first coupler for receiving the first power supply terminal and a second opening of the second coupler for receiving the second power supply terminal are both open to the one side.

4. The intake control device according to claim 1, comprising an opening degree sensor configured to detect a rotation angle of the drive transmission shaft, wherein the opening degree sensor is located at an end of the drive transmission shaft on a side on which the second transmission mechanism is located as seen from a direction parallel to the passage center line.

5. The intake control device according to claim 1, wherein the seal plane is inclined toward the upstream side of the intake passage with respect to the extending direction of the intake passage from the one side to the other side of the intake passage.

* * * * *